US008128006B1

(12) United States Patent
Goldschein et al.

(10) Patent No.: US 8,128,006 B1
(45) Date of Patent: Mar. 6, 2012

(54) APPARATUS AND METHOD FOR DISPENSING FLAVORING SUBSTANCE

(76) Inventors: Jennifer Goldschein, New York, NY (US); Geoffrey Goldschein, New York, NY (US)

( * ) Notice: Subject to any disclaimer, the term of this patent is extended or adjusted under 35 U.S.C. 154(b) by 527 days.

(21) Appl. No.: 12/321,879

(22) Filed: Jan. 26, 2009

(51) Int. Cl.
*A62C 13/62* (2006.01)

(52) U.S. Cl. ..... 239/309; 141/4; 239/10

(58) Field of Classification Search ..... 141/1, 4, 141/18, 346, 348, 351, 383–386; 222/83, 222/145.5; 206/219; 426/66, 77, 83; 239/309, 239/10
See application file for complete search history.

(56) References Cited

U.S. PATENT DOCUMENTS 3,154,222 A 10/1964 Heckman
3,463,361 A 8/1969 Cook et al.
3,831,742 A * 8/1974 Gardella et al. ..... 206/219
4,387,809 A 6/1983 Botzler
4,717,016 A 1/1988 Dalgleish
4,816,268 A 3/1989 Tsau
4,891,232 A 1/1990 Dahl
4,984,923 A 1/1991 Ota
5,094,861 A 3/1992 D'Auguste et al.
5,125,534 A 6/1992 Rose et al.
5,440,976 A 8/1995 Giuliano et al.
6,959,839 B2 11/2005 Roth et al.

* cited by examiner

*Primary Examiner* — Davis Hwu
(74) *Attorney, Agent, or Firm* — Lawrence G. Fridman

(57) ABSTRACT

An apparatus for dispensing a flavoring substance into a consumable beverage by a dispensing device consisting of a tubular body having a substantially hollow interior and formed with valves provided at distal and proximal ends thereof. Upon positioning of the tubular body into the container, the distal end of the body is pressed against interior of the container, so as to activate the distal valve. The proximal valve is activated to break a vacuum in the interior chamber and to enable the flavoring substance to pass through the open distal valve into the consumable beverage.

16 Claims, 5 Drawing Sheets

APPARATUS AND METHOD FOR DISPENSING FLAVORING SUBSTANCE

FIELD OF THE INVENTION

The present invention relates generally to dispensing devices and methods, and more particularly it relates to the method and device for dispensing flavoring substances into consumable drinks or beverages.

BACKGROUND OF THE INVENTION

In the field of beverage dispensing products, there is an obvious need in providing and/or adding flavors to consumable fluids such as alcoholic and non-alcoholic beverages, coffee and tea in a fast and convenient manner at a location of their consumption. The use of convenience type flavoring and dispensing devices has been recognized as an effective way to flavor beverages or drinks and accommodate the needs of a modern consumer. An essential advantage of such flavoring and dispensing devices is in their use at locations remote from regular food or drink preparation areas. These devices can also be used to add flavor in the kitchen environment without utilization of special equipment such as mixers, etc. Such dispensing devices are particularly useful in party and office environments, bars, restaurants, home entertainment areas, recreational areas and any other environment at which beverages are prepared, served and consumed. It appears that there is a very limited number of available prior art flavor dispensing devices which are capable of dispensing a flavor into a respective consumable fluid or drink based on vacuum breaking principal.

Many of the prior art dispensing devices are structurally complicated and often adapted for use by both hands of a user. This approach usually is not convenient to a consumer, especially considering that in the environments where the devices of the invention are often used, one hand of a user is typically occupied by food or eating utensils. Thus, only one hand of the user is available for activation of the dispensing device. Furthermore, there are practically no liquid dispensing devices available which are adapted for use by manually challenged individuals such as arthritic persons and other individuals with limited hand dexterity. Despite a number of dispensing devices on the market, there remains a need for a disposable dispensing device which is comfortable and easy to hold and operate, especially in view of the user's physical limitations.

Thus, it has been long felt and an unsolved need to provide an apparatus and method for dispensing and mixing flavoring substances such as fluids into consumable drinks which are simple in structure and reliable in use, wherein operation of the device can be used by many individuals especially in the circumstances where only one hand of a user is available.

SUMMARY OF THE INVENTION

One aspect of the invention provides a method of dispensing a liquid flavoring substance into a consumable fluid situated in a container by means of a dispensing device. The device consists of a tubular body having a substantially hollow interior forming a chamber adapted to accommodate a flavoring fluid. The tubular body is formed with valve arrangements provided at distal and proximal ends thereof. The method consists of the following steps. Initially, a tubular body is positioned into a container with a consumable fluid. The distal end of the tubular body is pressed against an interior wall of the container, so as to activate the distal valve arrangement. The vacuum is broken in the interior chamber by activating the proximal valve arrangement, so as to enable the liquid flavoring substance to pass through the open distal valve and to mix with a consumable fluid. The device is adapted for multiple applications, so that it can be opened and closed multiple times discharging various amounts of flavoring substance to accommodate taste requirements of different consumers. In view of the proprietary exterior design, the device of the invention also provides a consumer with stirring or mixing capabilities often required to dispense the flavor within the volume of the drink.

As to another aspect of the method of the invention, the proximal valve arrangement is pressure activated and the tubular body is held by a hand of the user, whereas in the step of breaking the vacuum, the pressure activated proximal valve is activated by applying pressure by a finger of the same hand of the user to the proximal valve. The pressure activated proximal valve is formed with an activating member at least partially extending outwardly from the body. In the method of the invention, the tubular body is held by fingers of the hand of the user, and in the step of breaking the vacuum, the proximal valve arrangement is activated by pushing the activating member by a thumb of the same hand of the user. As to a further aspect of the invention, the dispensing device further comprises at least one flexible membrane positioned within the substantially hollow interior of the body, whereby in the method of the invention, the membrane is punctured upon activation of one of the respective valve arrangements.

As to still another aspect of the invention, a first membrane is provided within the substantially hollow interior in the vicinity of the distal valve arrangement and a second protective membrane is provided in the vicinity of the proximal valve arrangement, wherein the first and second membranes are punctured by the respective engaging portions upon activation of the respective valves.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

DETAILED DESCRIPTION OF THE INVENTION

Figure 1:
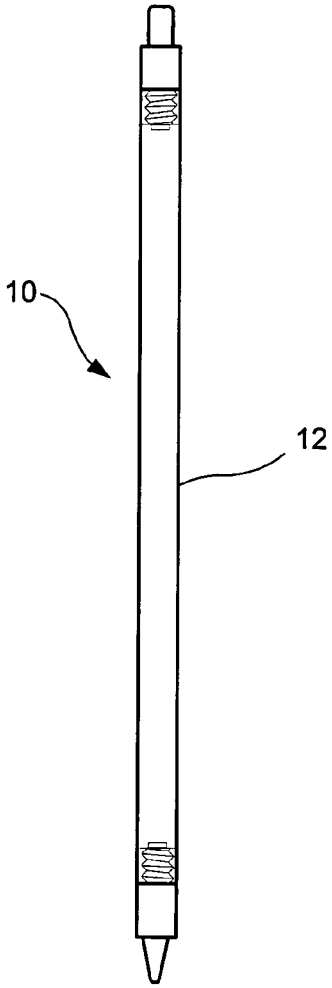
FIG. 1 is an elevational view showing the device for dispensing flavoring substance of the invention.

Referring now to the drawings in general and FIGS. 1-4 in particular, where the dispensing device 10 according to a preferred embodiment of the invention is best illustrated. The dispensing device 10 typically consists of an elongated tubular body 12 having a substantially hollow interior 14 forming a chamber 16 adapted for receiving a flavoring liquid. A distal valve arrangement 20 is positioned at a distal end 18 and a proximal valve arrangement 40 is provided at the proximal end 19 of the tubular body. In the preferred embodiment of the invention, the distal and proximal valve arrangements are formed having similar configuration. On the other hand, use of the distal and proximal valves having different configuration is also contemplated. To minimize the cost of the manufacturing, the tubular body and the valves can be made of polyethylene. Additional rigidity of the tubular body may be accommodated through the use of suitable plastic materials having various characteristics. Cost of the materials is especially important, where the invention is a single use disposable device.

Figure 2:
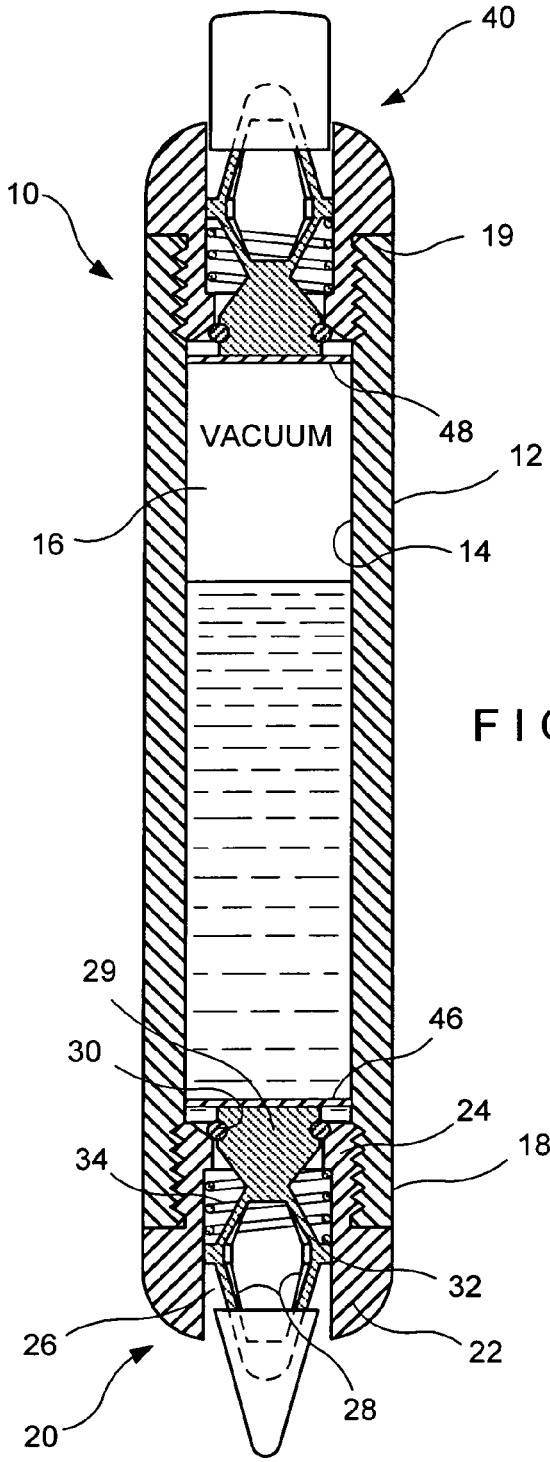
FIG. 2 shows a cross-sectional view of the dispensing device of the invention in its initial condition.
Figure 3:
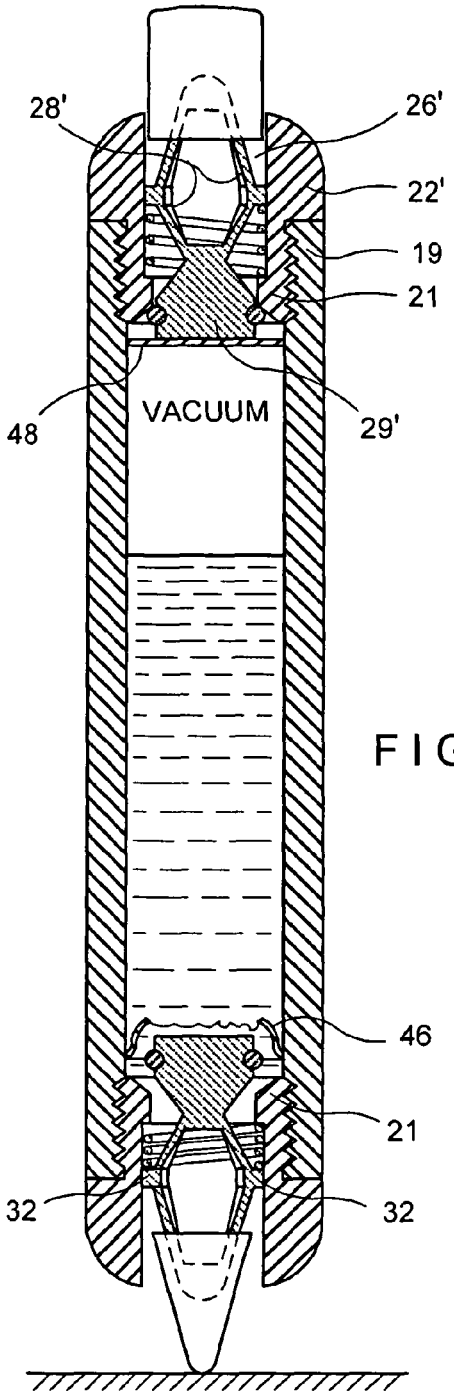
FIG. 3 shows a cross-sectional view of the dispensing device having activated the distal valve arrangement.
Figure 4:
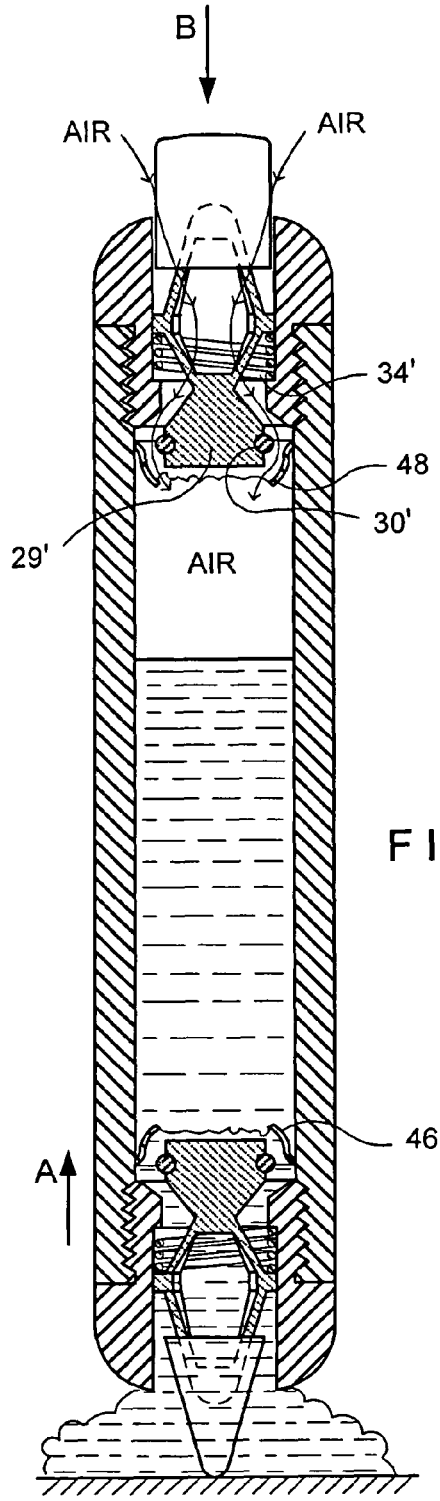
FIG. 4 is a cross-sectional view of the dispensing device of the invention in the condition with the distal and proximal valve arrangements being activated.

As clearly illustrated in FIGS. 2-4, the distal valve arrangement 20 is formed with a collar 22 fixedly positioned at the distal end 18 of the tubular body. A rear portion 24 of the collar narrows in the internal diameter and is adapted for fixable engagement with the interior of the tubular body. A stop portion 21 is formed at the inner end of the collar. A control member 26 is provided for slidable motion within the collar and consists of a stem 28 and an engaging part 29 extending outwardly therefrom. In one embodiment, the stem 28 can be formed with elongated grooves or relieves (not shown) facilitating passage of a flavoring liquid during operation of the device. The engaging portion 29 is formed having a semi-conical configuration with seal formation 30 which can be in the form of a groove adapted to accommodate a respective seal. In one embodiment of the invention (see FIGS. 2 and 3), the seal is in the form of an O-ring. The seal formation 30 engages the stop portion 21 of the collar in the closed position of the distal valve 20. The stem 28 of the control member 26 movably engages the inner area of the collar through exterior guiding elements 32 extending from a middle section thereof. In the assembled condition (see FIGS. 2-4), the control member 26 is positioned within the collar in such a manner that a biasing member 34 is interposed between the inner area of the stop portion 21 and the exterior guiding elements 32. Slidable engagement between the guiding elements 32 and the cylindrical inner area of the collar 22 assures integrity and alignment of the respective elements.

As illustrated in FIG. 2, in the non-activated condition of the distal valve 20, the biasing member 34 presses against the exterior guiding elements 32, forcing the stem 28 to extend outwardly from the tubular body and forcing the seal formation 30 into engagement with the stop portion 29. In this position, the distal valve arrangement 20 is closed and the flavoring liquid is prevented from flowing out of the collection chamber 16. As illustrated in FIGS. 3 and 4, in order to activate the distal valve arrangement 20, the distal end of the stem 28 or control member is pressed in the direction of Arrow A, causing inward slidable movement thereof and compression of the biasing member 34. In the same motion, the seal 30 disengages the interior of the stop portion 29, so as to form a passage allowing flow of the fluid from the chamber 16.

When pressure on the distal end of the stem 28 is discontinued, the biasing member 34 is released, forcing the control member 26 into the extended position with the seal 30 engaging the stop portion. In this manner, the flow of flavoring liquid from the accumulation chamber 16 is stopped. The preferred embodiment of the invention has been described utilizing the liquid form of the flavoring substance having various degrees of viscosity. As an example, the flavoring substance can be in the form of a syrup or a mixture of liquid and solid phases, where the solids are at least partially dissolved within the liquid. On the other hand, utilization of the flavoring substance in a solid or semi-solid form is also contemplated.

In the preferred embodiment of the invention, the structure of the proximal valve 40 is substantially similar to that of the above-discussed distal valve 20. In this manner, the proximal valve sub-assembly consists of a collar 22' fixably positioned at the proximal end 19 of the tubular body. The respective control member 26' is also provided for slidable motion within the collar and consists of a stem 28' and an engaging part 29' extending outwardly therefrom.

The function of the proximal valve 40 is similar to the function of the distal valve 20. However, a further essential function of positioning the proximal valve 40 at the proximal end 19 of the tubular body 12 with the stem 28' extending outwardly, is to facilitate the vacuum breaking function. In this application, as best illustrated in FIGS. 3 and 4, the seal formation 30' and the engaging part 29', positioned within the hollow interior, engage the collar stop portion 21', in the manner discussed hereinabove. Upon activation, the proximal valve stem 26' is pressed by the user (in the direction of Arrow B) causing compression of the biasing member 34'. Since the seal 30' disengages the interior stop portion 21' of the respective collar, the passage is formed allowing outside air to enter the collecting chamber 16, so as to break the vacuum thereinside. If the distal valve is simultaneously activated (as illustrated in FIG. 4), flow of the liquid flavoring substance is initiated through the passage formed in the distal valve 20, allowing the flavoring liquid to mix with the consumable beverage. When the user discontinues pressure on the stem 28' of the control member 26', the proximal valve 40 is closed and flow of flavoring liquid into the container with the drink is stopped. Thus, the user has the ability to incrementally discharge the flavoring fluid accumulated in the interior chamber into the drink. The incremental discharge of the flavoring substance can be also provided through opening and closing the distal valve 20. In this manner, the device of the invention provides the ultimate consumer with control functions over volume and concentration of the flavoring fluid in the consumable beverage to accommodate various taste requirements.

As illustrated in FIGS. 2-4, to prevent contamination or leakage of flavoring liquid while it is in storage or transportation, prior to use of the device, at least one flexible membrane 46, 48 can be incorporated within the hollow interior 14 of the tubular body 12. The membrane 46, 48 has to be forcibly punctured through activation of the respective valve to initiate the flow of flavoring fluid. The membranes can be provided in the accumulation chamber either at one end or at both distal and proximal ends of the tubular body in the vicinity of the respective valves. The distally positioned membrane 46 is punctured during the movement of the engaging portion 29, when the distal valve arrangement 20 is activated by pressing the control 26 to extend inwardly. The proximal membrane 48 is punctured by the respective engaging portion 29' when the control 26' of the proximal valve 40 is pressed in the direction of Arrow B. Typically, the membranes are made of an easily pierceable material such as a thin layer of plastic, etc. The dispensing device 10 can be a single use disposable arrangement or can be formed having refilling capabilities. In the latter instance, upon dispensing the flavoring substance situated within the chamber 16, additional substance can be added, by for example, removal of one of the valves. After the chamber 16 is refilled with a fresh portion of the flavoring substance, the respective valve is positioned back in the tubular body 12.

The dispensing devices can be individually sealed with an end cap for further ensuring sterilization. With an end cap, there will be no leakage of the flavoring liquid during transportation and storage. A thin film collar can also be considered as an additional safety feature, where it could not be depressed until adequate pressure is asserted then allowing the end cap to snap off.

A method of dispensing a liquid flavoring substance into a consumable beverage is adapted for use with the dispensing device 10 discussed hereinabove. An important advantage of the device and method of the invention is, that it is not only comfortably usable in any environment by many individuals, but also is adaptable to use by individuals with some physical limitations. Actually, the method of the invention is especially adapted when only one hand of a user is available for dispensing a flavoring liquid into consumable beverages.

The invention also provides a method of dispensing a flavoring liquid into a consumable beverage situated in a container by means of the above-discussed dispensing device 10'. The method consists of the following steps. Positioning the tubular body 12 into the container with a consumable beverage. Pressing the distal end of the tubular body against the interior wall or bottom of the container, so as to activate the distal valve arrangement 20. A vacuum is broken in the interior chamber 16 by activating the proximal valve arrangement 40, so as to enable the flavoring liquid to pass through the distal valve opening and to mix with the consumable beverage.

Referring now to FIGS. 5-10 illustrating in detail the method of dispensing, mixing and/or stirring the liquid flavoring substance of the invention. FIGS. 5-8 illustrate the embodiment of the method where one hand of the user is used for operation of the device. According to this embodiment of the method, the tubular body 12 is held with the hand of a user and the proximal valve is activated by applying pressure by a finger of the same hand to the outwardly extending stem 28'. The tubular body 12 can be held by at least two fingers of the hand, and in the step of breaking the vacuum, the proximal valve is activated by pushing the activating member or stem 28' by a thumb or other fingers of the same hand of the user. The tubular body can be also held by three fingers of the hand or any other combination of fingers which makes the user comfortable for operation of the device. In the one-handed operation of the device of the invention, the tubular body can be held by any combination of fingers of the hand of the user whereas the activating member 28' can be pushed by fingers of the same hand other than the thumb. In view of the elongated design of the tubular body 12, the device of the invention also provides a use with a mixing/stirring capability, where the flavoring substance after being dispensed into the drink is efficiently mixed through its entire volume.

Figure 6:
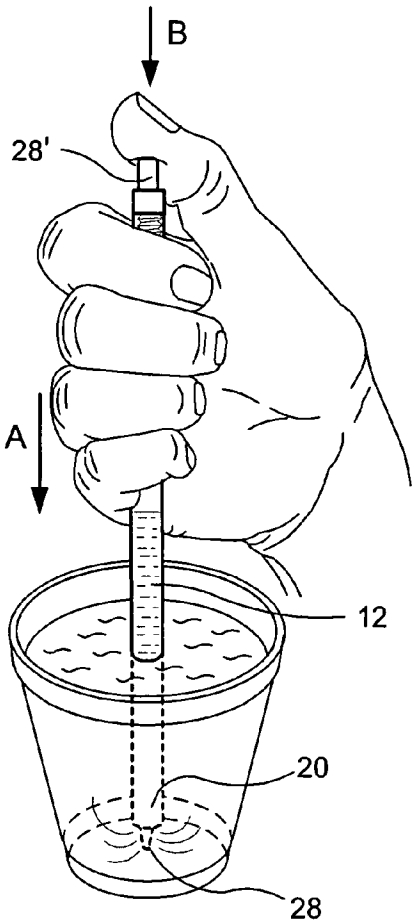
FIG. 6 illustrates a further step according to the method of the invention.
Figure 5:
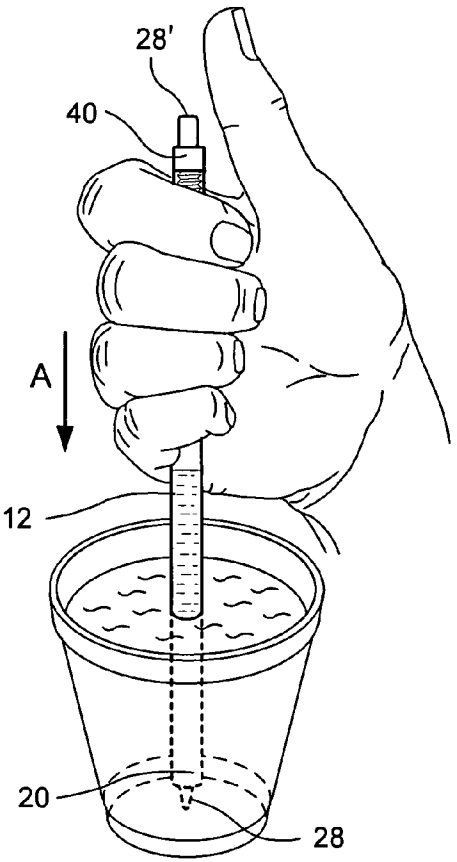
FIG. 5 illustrates positioning of the device within a container in accordance with one embodiment of the method of the invention.
Figure 8:
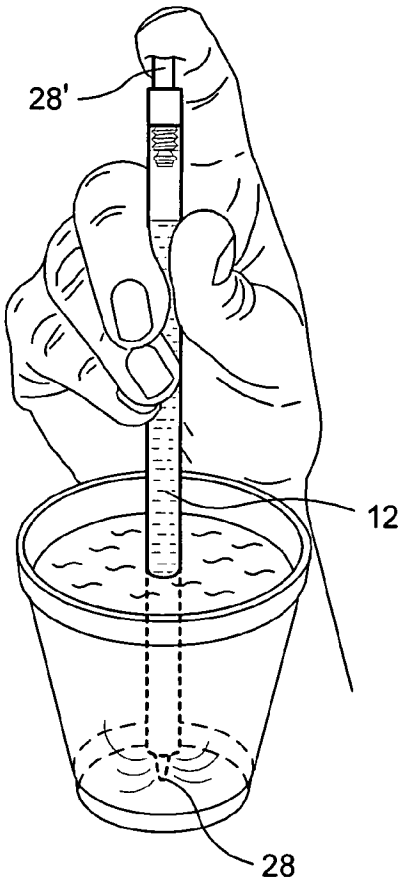
FIG. 8 illustrates a still further step of the method of the invention.
Figure 7:
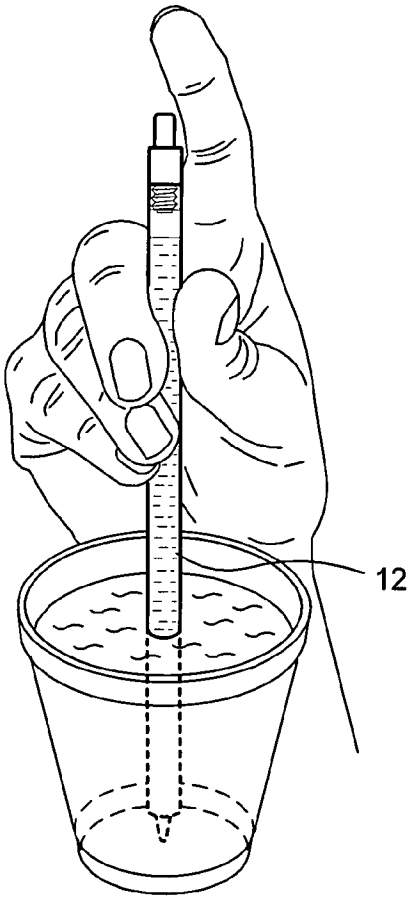
FIG. 7 illustrates an alternate step in accordance with the method of the invention.

As illustrated in at least FIGS. 5 and 6, in the step of activating the distal valve arrangement, the tubular body is held by the fingers of the hand, while the distal end of the tubular body is pressed against the interior wall or bottom of the container.

FIGS. 2-4 illustrate the embodiment of the invention where the first protective membrane 46 is provided within the substantially hollow interior 16 in the vicinity of the distal valve arrangement 20 and the second membrane 48 is provided in the vicinity of the proximal valve arrangement 40. The first and second protective membranes 46, 48 are punctured by the respective engaging portions upon activation of the respective valves.

Figure 10:
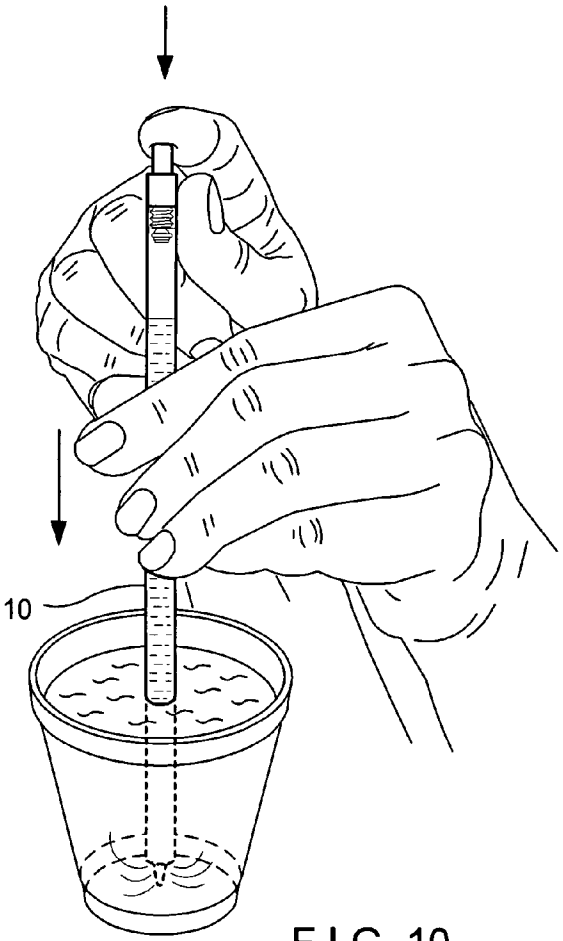
FIG. 10 illustrates operation of the device of the invention in accordance with a further aspect of the method of the invention.
Figure 9:
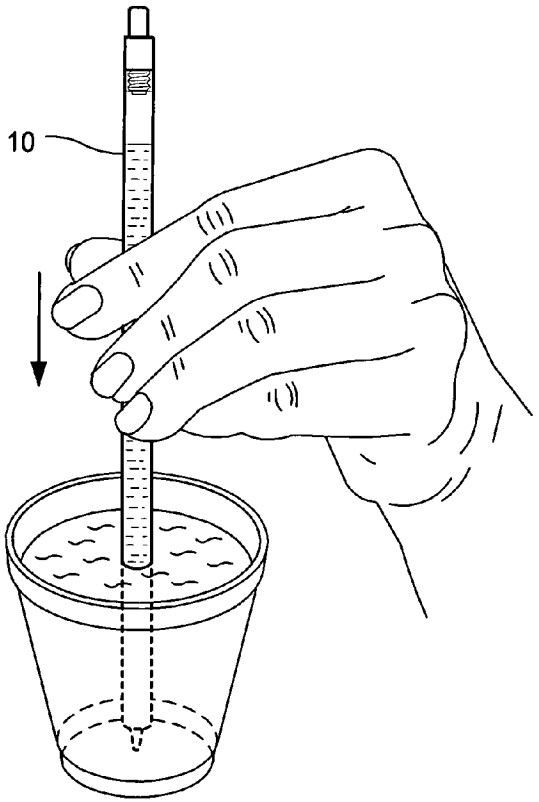
FIG. 9 illustrates positioning of the dispensing device within a container with a consumable fluid.

The dispensing apparatus 10 of the invention is also applicable for use by both hands of the user. This embodiment of the method is illustrated in FIGS. 9 and 10. In this instance, the body 12 is held by the fingers of one hand, whereas in the step of breaking the vacuum, the pressure activated proximal valve 40 is activated by applying pressure by fingers of the other hand of the user.

Thus, the invention provides the disposable apparatus and the respective method for dispensing and mixing flavoring substances into consumable drinks which are simple and reliable in use, wherein operation of the device is acceptable to many individuals. The device is capable of controlling flavor intensity to accommodate taste of various individuals and is especially convenient in the situation where only one hand of the user is available for dispensing flavoring fluids.

What is claimed is:

1. A method of dispensing a flavoring liquid substance into a consumable fluid situated in a container by means of a dispensing device which consists of a tubular body having a substantially hollow interior forming a chamber adapted to accommodate a flavoring substance, the body is formed with valve arrangements provided at distal and proximal ends thereof, a first protective membrane provided within the substantially hollow interior in the vicinity of the distal valve arrangement and a second protective membrane provided in the vicinity of the proximal valve arrangement, the method consists of the following steps:

positioning the tubular body into a container with a consumable fluid; pressing the distal end of the tubular body, so as to activate the distal valve arrangement;

breaking a vacuum in the interior chamber by activating the proximal valve arrangement, puncturing the first or second protective membranes upon activation of the respective valves, and enabling the flavoring liquid substance to pass through the activated distal valve arrangement and to mix with the consumable fluid provided in the container situated outside of the dispensing device.

2. A method according to claim 1, wherein said proximal valve arrangement is a pressure activated valve, in said step of positioning said tubular body is held by a hand of a user, and in said step of breaking vacuum the pressure activated proximal valve arrangement is activated by applying pressure by a finger of the same hand to said proximal valve.

3. The method of claim 2, wherein said pressure activated proximal valve arrangement is formed with an activating member of at least partially extending outwardly of said body, said tubular body is held by fingers of the hand of the user, and in said step of breaking the vacuum the proximal valve is activated by pressuring the activating member by a finger of the same hand of the user.

4. The method of claim 3, wherein the finger used for pressing the activating member is a thumb, index finger, etc. of the same hand of the user.

5. The method according to claim 2, wherein in the step of activating the distal valve arrangement, the tubular body is held by at least three fingers of the hand, while the distal end of the tubular body is pressed against an interior of the container.

6. The method of claim 5, wherein in said step of positioning, the tubular body is being held by the index, middle and next to last finger.

7. The method of claim 2, wherein said tubular body is being held by fingers of one hand of the user whereas in said step of breaking the vacuum, the proximal valve arrangement is activated by another hand of the user.

8. The method of claim 7, wherein the tubular body is held by at least index, middle and next to the last fingers of one hand of the user and the proximal valve arrangement is activated by a thumb of the other hand of the user.

9. The method of claim 1, wherein each said distal and proximal valve arrangement comprises a control member adapted for slidable motion within the respective part of the tubular body, the control member consists of a stem and engaging portion extending outwardly therefrom, the first and second protective membranes are punctured by the respective engaging portions upon activation of the respective valves.

10. A device for dispensing a flavoring liquid substance, comprising:

a tubular body having a substantially hollow interior forming a chamber adapted to accommodate a flavoring liquid, a distal valve arrangement provided at a distal end of the tubular body, a proximal valve arrangement provided at the proximal end of the tubular body, upon activation of the distal valve arrangement communication is established between the substantially hollow interior chamber and exterior of the tubular body; upon activation of the proximal valve arrangement communication is established between the interior chamber, the proximal valve arrangement and atmosphere, so as to break a vacuum within the interior chamber; and a first protective membrane provided within the substantially hollow interior at the distal valve arrangement and a second protective membrane provided at the proximal valve arrangement, the first or second protective membranes are punctured upon activation of the respective valves, so as to enable the flavoring liquid substance to pass through the activated distal valve and to mix with a consumable fluid disposed outside of the tubular body.

11. The device of claim 10, further comprising a proximal activating member movably positioned within the proximal valve arrangement, and a distal activating member movably positioned within the distal valve arrangement.

12. The device of claim 11, wherein each said distal and proximal valve arrangement comprises a control member adapted for slidable motion within the respective part of the tubular body, the control member consists of a stem and engaging portion extending outwardly therefrom, the first or second protective membranes are punctured by the movement of the respective engaging portions upon activation of the respective valves.

13. The device of claim 10 wherein, each said distal and proximal valve arrangement comprises a control member adapted for slidable motion within the respective part of the tubular body, the control member consists of a stem and engaging portion extending outwardly therefrom, a collar is positioned at the respective end of the tubular body, a seal formation is provided between the engaging part of the control member and a rear part of the collar, the stem movably engages an inner area of the collar through exterior guiding elements extending outwardly therefrom.

14. The device of claim 13, wherein a biasing member is interposed between the inner area of the collar and the exterior guiding elements.

15. The device of claim 14, wherein in a non-activating condition of the respective valve arrangement the biasing member presses against the exterior guiding elements forcing the stem to extend outwardly from the tubular body and forcing the seal formation into engagement with the respective part of the valve arrangement, so as to cause closure thereof.

16. The device of claim 14, wherein the seal formation is adapted for engagement with the collar, to activate the respective valve arrangement the stem is pressed inwardly causing compression of the biasing member resulted in disengagement of the seal formation and the collar, so as to form a passage therebetween and allowing a flow of the flavoring liquid from the chamber.

* * * * *